US007377247B2

(12) United States Patent
Seitz

(10) Patent No.: US 7,377,247 B2
(45) Date of Patent: May 27, 2008

(54) ADJUSTABLE VALVE ROCKER LEVER OF A VALVE TIMING GEAR OF AN INTERNAL COMBUSTION ENGINE

(75) Inventor: Joachim Seitz, Reundorf (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/595,257

(22) Filed: Nov. 9, 2006

(65) Prior Publication Data

US 2007/0101958 A1 May 10, 2007

(30) Foreign Application Priority Data

Nov. 10, 2005 (DE) ..... 10 2005 053 596

(51) Int. Cl.
*F01L 1/18* (2006.01)

(52) U.S. Cl. ..... 123/90.39; 123/90.16; 123/90.44; 74/569

(58) Field of Classification Search ..... 123/90.16, 123/90.2, 90.39, 90.44, 90.6; 74/559, 567, 74/569

See application file for complete search history.

(56) References Cited

U.S. PATENT DOCUMENTS 7,201,126 B1 * 4/2007 Seitz ..... 123/90.39

FOREIGN PATENT DOCUMENTS

| | | | |
|---|---|---|---|
| DE | 27 53 197 | A1 | 6/1978 |
| DE | 101 37 490 | A1 | 2/2003 |
| DE | 101 55 825 | A1 | 5/2003 |
| DE | 102 57 705 | A1 | 6/2004 |
| DE | 103 16 189 | A1 | 10/2004 |
| DE | 103 47 329 | A1 | 5/2005 |
| EP | 1 367 228 | A1 | 12/2003 |
| EP | 1 568 851 | A1 | 8/2005 |
| WO | WO 2005/093224 | A1 | 10/2005 |

* cited by examiner

*Primary Examiner*—Ching Chang
(74) *Attorney, Agent, or Firm*—Charles A. Muserlian

(57) ABSTRACT

An adjustable valve rocker lever (1) of a valve timing gear of an internal combustion engine comprising an inner lever (3) and an outer lever (4) enclosing the former with its arms (2), the levers (3, 4) being connectable to one another by longitudinally displaceable coupling links (6) in such a way that a large valve lift is generated when coupled and a small valve lift is generated when decoupled, the levers (3, 4) run on a common axis (5), which viewed in the longitudinal direction is arranged between a complementary face (11) for a support element on the inner lever (3) and lifting faces (12, 13) for the lifting cams on upper sides of the levers (3, 4), wherein by virtue of its axis (5), situated close to the pivot point, such a valve rocker lever (1) has only a small mass moment of inertia about this pivot point.

10 Claims, 1 Drawing Sheet

ADJUSTABLE VALVE ROCKER LEVER OF A VALVE TIMING GEAR OF AN INTERNAL COMBUSTION ENGINE

FIELD OF THE INVENTION

The invention relates to an adjustable valve rocker lever of a valve timing gear of an internal combustion engine, having an inner lever and an outer lever enclosing the former with its arms, the levers running on a common axis so that they can swivel relative to one another and being connectable to one another by way of coupling links in such a way that a large valve lift is generated when coupled and a smaller or zero valve lift is generated when decoupled, the inner lever on an underside at one end having a seating face for an exhaust and refill valve and at the other end a complementary face for a support element, and the outer lever on each arm having a lifting face for a main lift cam and the inner lever having a lifting face for a low or zero lift cam, and a lost-motion spring being provided between the levers.

BACKGROUND OF THE INVENTION

Such a valve rocker lever is disclosed by the generic DE 103 10 226 A1. At an end directly opposite the valve side, said rocker lever has a connecting axis on which the lever parts are supported so that they are capable of swiveling in relation to one another. At the other end a longitudinally displaceable coupling link (piston), which for coupling can be slid under a cross bar connecting the arms of the outer lever at the end, is provided in the inner lever in the area above a complementary face for bearing on a head of a support element.

One striking feature is that the axis is relatively remote from the pivot point of the entire lever. The valve rocker lever as a whole therefore has an unnecessarily high mass moment of inertia about this point. It will likewise be readily apparent that owing to the axis situated far out at one end the outer lever when decoupled also has an unnecessarily high mass moment of inertia. When coupled, the outer lever is also subject to an unnecessarily large deflection during cam actuation, which has to be braced by corresponding reinforcements. Furthermore, the overall width of the lever is relatively large, so that fitting problems can arise here.

OBJECT OF THE INVENTION

The object of the invention, therefore, is to create a valve rocker lever of the aforementioned type, in which the disadvantages cited are eliminated. In particular it is intended to create a valve rocker lever that is optimized with regard to its mass moment of inertia and deflection.

SUMMARY OF THE INVENTION

According to the invention this object is achieved in that the axis, viewed in the longitudinal direction of the valve rocker lever, is arranged between the complementary face for the support element and the lifting faces for the lifting cams, the arms of the outer lever at one end terminating in end faces directly after their lifting faces and the inner lever, at least with an area of its seating face for the exhaust and refill valve, protruding lengthwise beyond the end faces of the arms of the outer lever.

This effectively eliminates the aforementioned disadvantages. Attention is focused here, in particular, on an adjustable valve rocker lever with longitudinal locking, in which a slide-like coupling link runs above the complementary face for the support element in the inner lever and can be brought into lengthwise engagement with a cross member of the outer lever at the other end. Where appropriate, however, a valve rocker lever with transverse locking is also catered for.

Compared to the prior art cited in the introductory part of the description, the axis has now clearly been shifted from one end towards the transverse center plane of the adjustable valve rocker lever. When coupled, therefore, a reduction of the mass moment of inertia about the pivot point (complementary face) is to be anticipated. This makes it possible to run at higher maximum speeds. At the same time, shifting the axis towards the center of the lever also leads to a reduction in the mass moment of inertia of the outer lever about the axis when decoupled. It is therefore also possible to run at higher speeds in their decoupled state.

At the same time the aforementioned deflection of the outer lever during cam contact and coupling is reduced, so that the valve rocker lever can be of less robust design dimensions.

According to the invention the arms of the outer lever terminate directly after the lifting faces for the respective main lift cams, thereby not only saving material in this area but also saving lateral space, at least at one valve-side end.

In one embodiment of the invention a torsion spring is provided as lost-motion spring, which is suitably held on the axis between one arm of the outer lever and the inner lever. Two lost-motion springs are preferably provided, which run inside the arms of the outer lever. Alternatively, other lost-motion springs such as helical compression springs or the like, which act between the levers, are also feasible. The use of torsion springs gives an adjustable valve rocker lever which is, in particular, of low overall height and has a compact design shape.

The slide (piston) above the complementary face in the inner lever which is proposed as coupling link can be very easily displaced essentially in one direction, by hydraulic fluid delivered from the head of the support element. In the other direction a return can be achieved by means of the force of a mechanical spring such as a helical compression spring or a helical extension spring. Other means of coupling can also be provided such as slide assemblies, balls, wedges etc. An alternative method of actuation such as magnetic or electromagnetic actuation etc. is also feasible.

In plan view the outer lever forms a box or U-shaped profile and is connected at one end by the cross member. The cross member on the one hand stabilizes the outer lever and on the other serves, with its upper side, as an outstanding stop face for the coupling link.

In order to provide a coordinated alignment of the coupling link with the complementary face on the upper side of the cross member, a stop is provided. This may take the form either of a shoulder, which emanates from an end face of the inner lever at the other end and which communicates with the underside of the cross member. Alternatively the arms of the outer lever, in the area of a transverse center plane of the valve rocker lever, can be connected by a cross member to the underside, on which the inner lever strikes with a bottom face. In the cam base circle a coordinated alignment of the coupling link with its corresponding counter-face is therefore created. It will be clear that in this area a slight coupling play has to be provided. This can be created, however, through a height of the complementary face on the cross member or the height of the centrally undercutting cross member. Where necessary, suitable adjusting shims can be placed in these areas.

According to a suitable further development of the invention at least one of the levers (outer lever or inner lever) is to be composed of a lightweight material such as sheet metal. This has an advantageous effect on manufacturing costs and the mass of the valve rocker lever. Where it is composed of sheet metal, the valve rocker lever should preferably be produced with its main components in a mass production stamping and bending process.

The area of the inner lever with the complementary face at the other end may be provided separately between the side walls of the inner lever. However, a separate arrangement behind a corresponding end face of the inner lever is also provided for. Alternatively the area of the complementary face with the corresponding mount for the coupling link may also be integrally formed with the inner lever.

In one embodiment of the invention a rotatable roller is provided as lifting face in the inner lever and slide faces are provided as lifting faces on the outer lever. Only the area which statistically or empirically has the most frequent cam contact therefore has the more costly turning connection. It may also be advisable, however, to provide all lifting faces with rotatable rollers or to provide all lifting faces solely with slide faces, or for the lifting faces on the outer lever to be rotatable rollers and the lifting face on the inner lever to be formed by a slide face.

BRIEF DESCRIPTION OF THE DRAWING

The invention is suitably explained in more detail with reference to the drawing, in which.

DETAILED DESCRIPTION OF THE DRAWING

Figure 1:
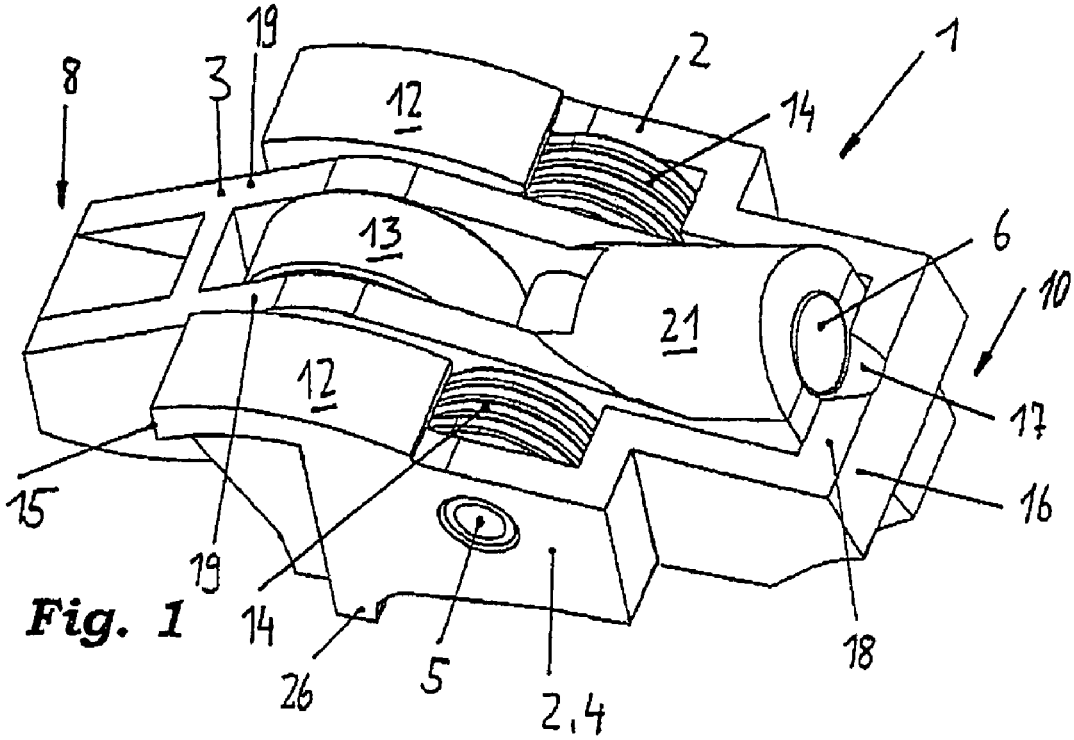
FIG. 1 in a three-dimensional view shows the valve rocker lever according to the invention and FIG. 2 shows a section along the longitudinal center plane of the valve rocker lever.
Figure 2:
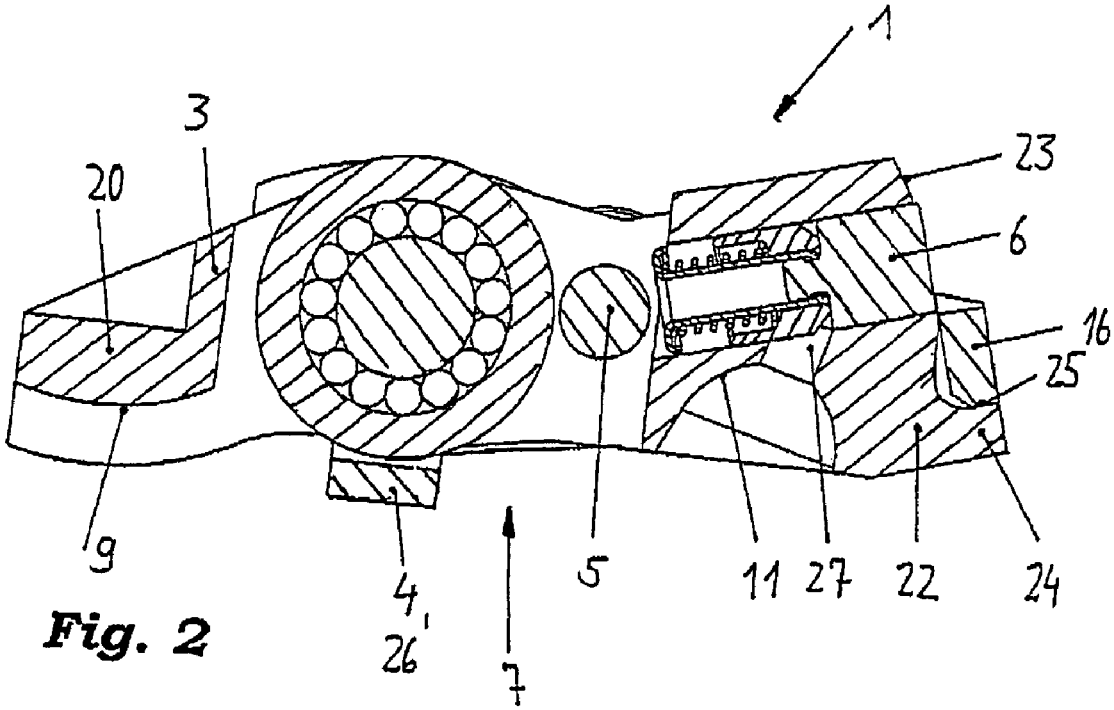

The figures show an adjustable valve rocker lever 1 of a valve timing gear of an internal combustion engine. This lever comprises a thin-walled outer lever 4, which in plan view is U-shaped, between the arms 2 of which a bar-like inner lever 3 with its side walls 19 is accommodated. The levers 3, 4 run on a common axis 5 and are capable of swiveling in relation to one another. The axis 5 lies in the area of a transverse center plane of the valve rocker lever 1.

At the one end 8 the inner lever 3 has a seating face 9 on the underside 7 for at least one exhaust and refill valve. At the other end 10 the inner lever 3 has a complementary face 11 on the underside 7 for bearing on a head of a support element. At the same time it can be seen that a longitudinally displaceable slide is positioned as coupling link 6 above the complementary face 11. Said slide can be shifted into its coupling position by hydraulic fluid. The latter can be conducted by way of a direct duct 27 out of the head of the support element in front of an inner face of the coupling link 6. For an intended coupling, the coupling link 6 is run hydraulically in sections out of the inner lever 3, for which purpose a cross member 16 at the other end 10, which connects the arms 2 of the outer lever 4, has a complementary face 17 on its upper side 18.

On the side of one end 8 the outer lever 4, after the axis 5, has two lifting faces 12 for respective main lift cams. Here these take the form of slide faces. In this transverse area between its side walls 19 the inner lever 3 has a rotatable and preferably roller-bearing-supported roller, which serves as lifting face 13, for a low-lift cam, for example.

It can be seen that the inner lever 3, with its section having a seating face 9 at one end 8, protrudes beyond end faces 15 of the outer lever 4. The outer lever 4 is therefore "truncated" immediately after its lifting faces 12. It is moreover shown that the inner lever 3, in the area of one end 8, is connected by a cross web 20, which has the aforementioned seating face 9 on its underside.

As FIG. 1 shows, the axis 5 is provided with two lost-motion springs, which here take the form of torsion springs. These springs 14 run axially between the arms 2 of the outer lever 4 and the arms 19 of the inner lever 3. In order to create the corresponding design space, the arms 2 of the outer lever 4 are of box-like shape in this area.

Two solutions are proposed in order to ensure a coordinated alignment of the inner lever 3 with the outer lever 4 on passage of the cam base circle. Either a shoulder 24 protrudes from a lower section 22 of the inner lever 3 at the other end 10. The cross member 16 of the outer lever 4 can come to rest on this with its underside 25.

Alternatively a cross member 26 can be used, which connects the arms 2 of the outer lever 4 approximately in the area of a transverse center plane of the valve rocker lever 1, undercutting the inner lever 3. For this purpose the inner lever 3, with a suitable area of its underside 7, may come to bear on an upper side of the cross member 26.

As explained at the beginning of the description, the axis 5, viewed in the longitudinal direction of the valve rocker lever 1, is arranged between the complementary face 11 for the support element and the lifting faces 12, 13 for the lifting cams. This axis 5 has therefore been shifted significantly further towards the lever center compared to the prior art cited in the introductory part of the description. It now lies significantly closer to the pivot point of the valve rocker lever 1 as a whole (complementary face 11). A reduction in the mass moment of inertia of the entire valve rocker lever 1 about this pivot point is thereby feasible, which can lead to an increase in the maximum speed when the valve rocker lever 1 is in the coupled state. At the same time the mass moment of inertia of the outer lever 4 about the axis 5 is also reduced in the decoupled state. In the coupled state, the outer lever 4 no longer experiences the relatively large deflection during cam actuation as is the case in the prior art cited in the introductory part of the description. The outer lever 4 may therefore be of less robust design dimensions.

LIST OF REFERENCE NUMERALS

1) valve rocker lever
2) arm
3) inner lever
4) outer lever
5) axis
6) coupling link
7) underside
8) end
9) seating face
10) end
11) complementary face
12) lifting face
13) lifting face
14) lost-motion spring
15) end face
16) cross member
17) complementary face
18) upper side

19) side wall
20) cross web
21) section
22) section
23) end face
24) shoulder
25) underside
26) cross member
27) duct

The invention claimed is:

1. An adjustable valve rocker lever (1) of a valve timing gear of an internal combustion engine, having an inner lever (3) and an outer lever (4) enclosing the former with its arms (2), the levers (3, 4) running on a common axis (5) whereby they can swivel relative to one another and being connectable to one another by way that a large valve lift is generated when coupled and a smaller or zero valve lift is generated when decoupled, the inner lever (3) on an underside (7) at one end (8) having a seating face (9) for an exhaust and refill valve and at the other end (10) a complementary face (11) for a support element, and the outer lever (4) on each arm having a lifting face (12) for a main lift cam and the inner lever (3) having a lifting face (13) for a low or zero-lift cam, and a lost-motion spring (14) being provided between the levers (3, 4), wherein the axis (5), viewed in the longitudinal direction of the valve rocker lever (1), is arranged between the complementary face (11) for the support element and the lifting faces (12, 13) for the lifting cams, the arms (2) of the outer lever (4) at one end (8) terminating in end faces (15) directly after their lifting faces (12) and the inner lever (3), at least with an area of its seating face (9) for the exhaust and refill valve, protruding lengthwise beyond the end faces (15) of arms (2) of the outer lever (4).

2. A valve rocker lever of claim 1, wherein at least one torsion spring or a set of torsion springs is provided as lost-motion spring (14), which is/are clamped on the axis (5) between an arm (2) of the outer lever (4) and the inner lever (3).

3. A valve rocker lever of claim 1, wherein in the inner lever (3), in the area above its complementary face (11) for the support element, a slide displaceable in the longitudinal direction of the valve rocker lever (1) is applied as coupling link (6), the arms (2) of the outer lever (4) at the other end (10) being connected by a strap-like cross member (16) and the coupling link (6) in the event of coupling being displaceable in sections on a complementary face (17) on an upper side (18) of the cross member (16).

4. A valve rocker lever of claim 3, wherein in the inner lever (3), comprises two essentially upright and thin-walled side walls (19), which at least in the area of one end (8) are connected by a cross web (20) to the seating face (9) for the exhaust and refill valve, the coupling link (6) running either in a separate insert between or at the face behind the side walls (19) or in a section (21) integrally formed with the side walls (19).

5. A valve rocker lever of claim 3, wherein from a lower section (22) of an end face (23) of the inner lever (3) at the other end (10) a shoulder (24) protrudes, on which in a base circle phase of the cams the cross member (16) strikes with its underside (25) for alignment of the coupling link (6) with the complementary face (17) on the upper side (18) of the cross member (16).

6. A valve rocker lever of claim 3, in that wherein on the underside (7) and in the longitudinal section of the lifting faces (12, 13) the arms (2) of the outer lever (4) are undercut by a cross member (26), on which, in a base circle phase of the cams, the inner lever (3) strikes with an underside for alignment of the coupling link (6) with the complementary face (17) on the upper side (18) of the cross member (16).

7. A valve rocker lever of claim 3 wherein the coupling link (6) is displaceable in at least one moving direction by hydraulic fluid, which can be conducted via a duct (27) breaching the complementary face (11) in the inner lever (3).

8. A valve rocker lever of claim 1, wherein at least one of the components, either the inner lever (3) or the outer lever (4), is composed of a thin-walled, lightweight material such as sheet metal.

9. A valve rocker lever claim 1, wherein a rotatable roller is provided as lifting face (13) in the inner lever (3) and slide faces are provided as lifting faces (12) on the outer lever (4).

10. A valve rocker lever of claim 1 wherein the coupling link (6) is displaceable in at least one moving direction by hydraulic fluid, which can be conducted via a duct (27) breaching the complementary face (11) in the inner lever (3).

* * * * *